219-121 SR
8/26/80 XR 4,219,727

United States Patent [19]

Bolt

[11] 4,219,727

[45] Aug. 26, 1980

[54] APPARATUS FOR PERFORATING A MOVING WEB

[75] Inventor: Reginald C. Bolt, London, England

[73] Assignee: Molins Limited, England

[21] Appl. No.: 931,122

[22] Filed: Aug. 4, 1978

[30] Foreign Application Priority Data

Aug. 5, 1977 [GB] United Kingdom ..... 32969/77
Oct. 15, 1977 [GB] United Kingdom ..... 42950/77

[51] Int. Cl.[2] ..... H05B 7/18

[52] U.S. Cl. ..... 219/384; 83/16; 131/15 B; 219/121 EB; 162/286; 264/154

[58] Field of Search ..... 219/383, 384, 121 EB; 131/15 R, 15 B; 83/16, 170, 171, 365; 156/272, 274; 93/1 R, 1 C; 99/358; 162/139, 192, 286; 264/154; 315/326; 326/6

[56] References Cited

U.S. PATENT DOCUMENTS

| | | | |
|---|---|---|---|
| 2,678,373 | 5/1954 | Suran | 219/384 |
| 2,763,759 | 9/1956 | Mito et al. | 219/384 |
| 3,198,934 | 8/1965 | Dubilier | 219/384 X |
| 3,385,951 | 5/1968 | Bancroft et al. | 219/384 |
| 3,622,751 | 11/1971 | Larive et al. | 219/384 |
| 4,025,752 | 5/1977 | Whitman | 219/384 |

FOREIGN PATENT DOCUMENTS

| | | | |
|---|---|---|---|
| 234498 | 7/1964 | Austria | 219/384 |
| 570440 | 9/1958 | Belgium | 219/384 |
| 1105699 | 4/1961 | Fed. Rep. of Germany | 219/384 |
| 1217203 | 12/1970 | United Kingdom | 219/384 |

*Primary Examiner*—Volodymyr Y. Mayewsky
*Attorney, Agent, or Firm*—Craig & Antonelli

[57] ABSTRACT

In a ventilated cigarette making system the tipping paper is perforated before assembly of the cigarettes using a spark perforator which is controlled by a feedback arrangement, in response to the resultant air permeability of the finished cigarettes, or the permeability of the tipping paper as monitored before assembly. Preferably the testing of the finished cigarettes is done in a modified Molins "CID 4" cigarette testing device. The averaged test signal is used to control the frequency of power supply to the spark perforator, whose electrodes are loaded with capacitors so that the change in frequency results in a change in the current flow through the electrodes, and thus the size of the holes produced.

6 Claims, 6 Drawing Figures

APPARATUS FOR PERFORATING A MOVING WEB

This invention relates particularly to apparatus which may be used to perforate paper used for tipping cigarettes, to provide ventilation and thus reduce the smoker's intake of carcinogens. However it may also be applicable to the perforation of other webs of paper and similar dielectric materials so as to increase their porosity.

There are several aspects to this invention which may be used separately or in any combination.

According to one aspect of this invention apparatus for perforating a moving web comprises at least one electrode on one side of the path of the web; at least one electrode opposed to the first electrode and on the other side of the path of the web; means for feeding a web of paper or the like between the electrodes at a predetermined speed; an A.C. power supply arranged to deliver a potential across the electrodes sufficient to produce a spark passing through the web of paper or the like and at a frequency such that a number of sparks are produced while each section of the web is in the vicinity of the electrodes, so that each perforation in the web is formed by the through passage of a number of sparks; and means for blowing air or other gas across the sparks.

According to another aspect of the present invention apparatus for perforating a moving web of tipping paper in a filter cigarette making system comprises a series of separate electrodes on one side of the path of the web, a co-operating electrode or set of electrodes on the other side of the path of the web, each of the said separate electrodes being connected by means of a respective capacitor to the output of a variable frequency high tension A.C. power supply, and control means arranged to monitor the porosity of the perforated web and/or the resistance to air flow through the perforations of the completed filter cigarettes and to regulate the frequency of the supply so as to vary the effective impedance of the capacitors and thus the current through the electrodes in order to achieve the desired porosity and/or air resistance.

When the frequency of the supply is increased, the porosity will thus be increased by the increase in size of the holes due to the increased current. It might be expected that an increase in frequency would also increase the number of holes formed by the sparks (i.e. decrease the spacing between successive holes). However, we have found that there is in practice a minimum hole spacing of about 0.5 mm for tipping paper moving at a typical speed of about 50 meters/minute. A high frequencies, after a hole has been formed by one spark, a number of succeeding sparks tend to follow an increasingly indirect route through the same hole, rather than form a new hole. Therefore at high frequencies of the order which we prefer, the hole spacing remains approximately constant, but adjustment of the frequency alters the current and hence the hole size.

The porosity monitoring device is preferably pneumatic, and may for example comprise a suction device over which the perforated paper passes, and having means to monitor the flow resistance provided by the perforated paper, for example by measuring the air pressure or air flow in the suction device. Air flow through the perforations of the completed cigarette may be tested in the manner described in our patent application No. 23271/77.

According to a further apect of the present invention, apparatus for producing tipped cigarettes with a desired degree of ventilation comprises means for spark-perforating a web of tipping paper, means for varying the degree of perforation of the tipping paper by varying the frequency of the power input to the perforating device, means adapted to measure the ventilation of at least some of the cigarettes assembled using the perforated tipping paper, and control means adapted to adjust the frequency of the supply to the perforating device accordingly so as to achieve the required degree of ventilation.

In a preferred arrangement the cigarettes are assembled using filter tips which have been perforated mechanically, as described for example in our copending application No. 32970/77. It is preferable to avoid the necessity to adjust mechnical perforating devices if possible, to ensure maximum reliability and so as to minimise the number of moving parts in the apparatus, and thus the present invention has a considerable advantage in that a controllable amount of ventilation of cigarettes can be obtained purely by varying the electrical input to the spark perforator. This arrangement is effective since it is the outer wrapping of the filter tip which is perforated electrically and thus of course controls the overall degree of ventilation, assuming the mechanically perforated holes in the filter itself are relatively large.

The arrangement of the invention also has the considerable advantage, compared to methods of assembling ventilated cigarettes using ready-perforated tipping paper, that the degree of ventilation is under the cigarette manufacturers control. Thus he can produce cigarettes having a consistent degree of smoke dilution even if some of the other manufacturing processes (apart from the actual perforation) previous to the final assembly of the cigarettes, normally tend to produce variable dilution (e.g. through inconsistent "plug wrap" porosity). Such control would clearly be impossible if the degree of perforation of the tipping paper was fixed.

Preferably, the air flow through the perforations is tested using the system described in our co-pending application No. 23271/77, in which the cigarettes are carried on a fluted conveyor through a testing station at which the major part of the cigarette wrapper is tested, preferably excluding the perforated part, except that at least one cigarette carrying station on the conveyor is arranged so as to test only the air flow through the perforations. Thus the testing device may be of the type shown in British Pat. specification No. 1,217,203 as modified by the drawing of application No. 23271/77.

Preferably, the apparatus includes a perforation monitoring circuit which is adapted to receive, from a testing device, timing signals signifying the presence of a cigarette whose ventilation characteristics is to be sampled, and a characteristic signal for that cigarette, the circuit being adapted to average the characteristic signal with the characteristics of a preset number of other cigarettes to produce a control signal for the perforating device.

Preferably the perforation monitoring circuit comprises a first input for the cigarette characteristic signal, a second input for a signal indicative of the presence of a cigarette in the test position, a third input for a signal indicative that the cigarette is one to be sampled, and means for forming an average of successive signals at the first input, which coincide with signals at the third input.

According to another aspect of the invention there is provided apparatus for spark perforation of a moving web including an electrode assembly comprising a plurality of pin electrodes arranged in a line on one side of the path of the moving web, and an elongate counter-electrode on the other side of the web which is aligned with the line of pin electrodes, and is movable in the direction of its length so as to register with a variable number of the pin electrodes, to provide a variable number of perforations per unit length of the web.

Preferably the line of the pin electrodes, and the elongate electrode, are arranged at an angle to the direction of movement of the web; the angle may be variable. In order to prevent or at least limit burning caused by the spark, air may be blown continuously across the surface of the web at the perforating station, preferably at right angles to the direction of travel of the web.

According to a further aspect of the invention the perforating head may comprise a first member forming a supporting surface for a web of material to be perforated; at least one electrode mounted in the member so as to be exposed at the supporting surface of the said member; a second member mounted adjacent the said first member and cooperating with the said surface of the first member to form a passage for the web; at least one electrode mounted in the second member so as to communicate with the said passage; and means for adjusting the spacing between the two said members.

The perforating head may also include a device for periodically increasing the spacing between the two members for a short period, so as to allow a paper-splice to pass through. Air passages may be provided in the head or in an associated manifold to allow cooling air to be blown over the electrode pins. The head may also be rotatably mounted to enable the angle of the line of electrodes to be altered relative to the direction of movement of the paper web.

Some embodiments of the invention will now be described by way of example with reference to the accompanying drawings in which.

Figure 1:
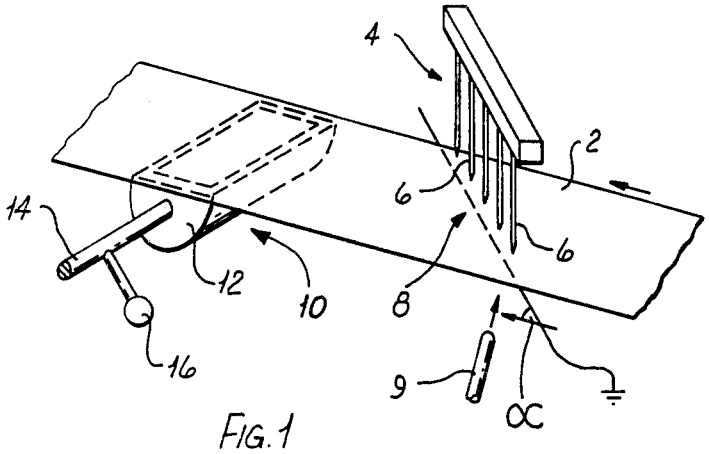
FIG. 1 is a diagrammatic perspective view of spark perforation apparatus in accordance with the invention.

Referring to FIG. 1, a web of paper 2 is moved past an electrode assembly 4 which includes a line of pin electrodes 6 which are arranged parallel to one another, and perpendicular to the surface of the web 2. The ends of the pin electrodes are close to the surface of the paper, and on the other side of the paper, and aligned with the line of pins, is an elongate counter-electrode comprising a rod 8. The spark gap is preferably of the order of 0.2 mm. The rod 8, and the line of pin electrodes, extend across the web at an acute angle $\alpha$ to its direction of travel; e.g. $\alpha=4°30'$. The electrodes are preferably made of thoriated tungsten containing 1–2% thorium, or of tungsten containing zirconium.

Air jets from a number of nozzles 9 (only one of which is shown) are arranged to blow across the surface of the web at the points of the pin electrodes so as to extinguish the arcs rapidly after they have been struck. The pressure of the air supplied to the nozzles is preferably adjustable.

The elongate rod electrode 8 may be automatically controlled as to its longitudinal position (especially if there are many more pin electrodes 6) to vary the number of perforations.

In order to keep the pin electrodes cool, air may also be blown past their upper ends, for example by mounting them in a hollow housing to which a supply of pressurised air is connected.

The speed of the paper travel through the apparatus may be of the order of 50 meters/minute.

A porosity monitoring device 10 is positioned downstream of the electrode assembly and comprises a suction box 12 having an open top across which the web travels after it has been perforated. The edges of the open top are smooth so that the web is drawn into close contact with the suction box by the suction, which is applied through a conduit 14 which also has a pressure transducer 16 connected to it.

Figure 2:
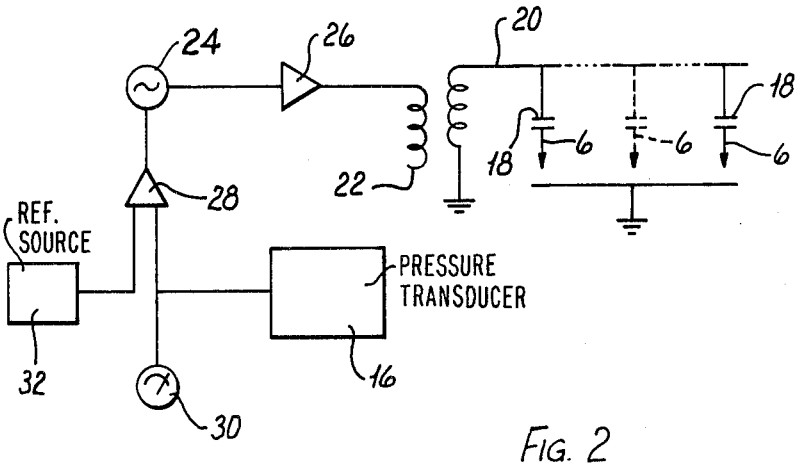
FIG. 2 is a block diagram of a control system for the apparatus of FIG. 1.

FIG. 2 shows the electrical circuitry of the apparatus. The pin electrodes 6 are each connected via a capacitor 18 to a common line 20 from the output transformer 22 of a 2000 Volt RMS A.C. power supply. The capacitors 18 may typically have values in the range 50–300 picofarads, whilst the high tension supply frequency may be variable in the range of 7–30 Khz. preferably over a 2:1 range, so the current supply provided for each pin by its corresponding capacitor will be of the order of 10 to 70 Milliamperes. In a typical operating condition the supply will be 3000 V at 15 Khz, and the capacitance per needle will be 200 pF, giving a needle current of 60 MA.

The supply frequency is varied to achieve the desired porosity by using the signal from the pressure transducer 16 to control an oscillator 24 which drives the main amplifier 26 of the power supply, whose output is of the order to a kilowatt or more. Thus the oscillator may for example be voltage controlled and the output of the pressure transducer may also be in the form of a voltage.

If the transducer 16 is arranged to measure back pressure in the suction line, as shown, its output will fall as the measured porosity of the web increases so that the frequency of the oscillator will be progressively decreased. Thus the effective impedance of the capacitors 18 will be increased, so that the spark power will be reduced, until a balance is reached. In order to allow a required porosity to be attained, a difference amplifier 28 having a reference source 32, is connected between the transducer 16 and the oscillator 24. If the transducer 16 is so arranged that its output increases with porosity, the amplifier 28 will be an inverting amplifier.

In either case, the desired porosity is set by adjusting the reference source 32, assuming other conditions (e.g. capacitance loading, electrode gap, material being perforated) remain constant. A porosity meter 30 is connected to the output of the transducer 16 to allow the porosity to be monitored.

The form of the apparatus described is particularly suitable for perforating tipping paper for cigarettes, in which case the paper will normally be in a double width, so that it can be used, in the assembly of filter cigarettes, to connect a length of cigarette rod onto each end of a double length filter plug which will later be cut in half. In this case two rows of perforations will be required, so two sets of electrodes will be provided.

Figure 3:
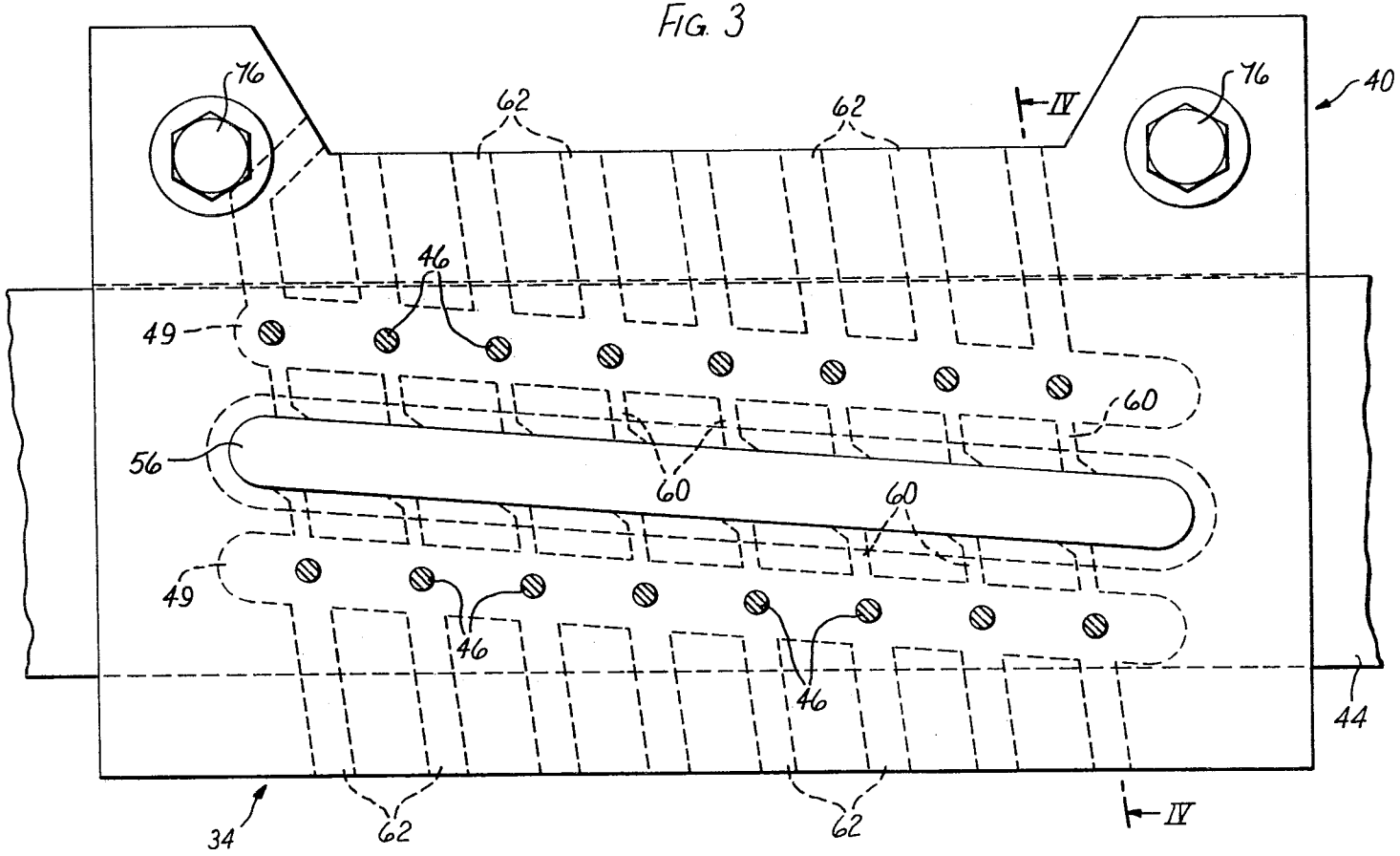
FIG. 3 is a horizontal cross-section through a further type of apparatus.
Figure 4:
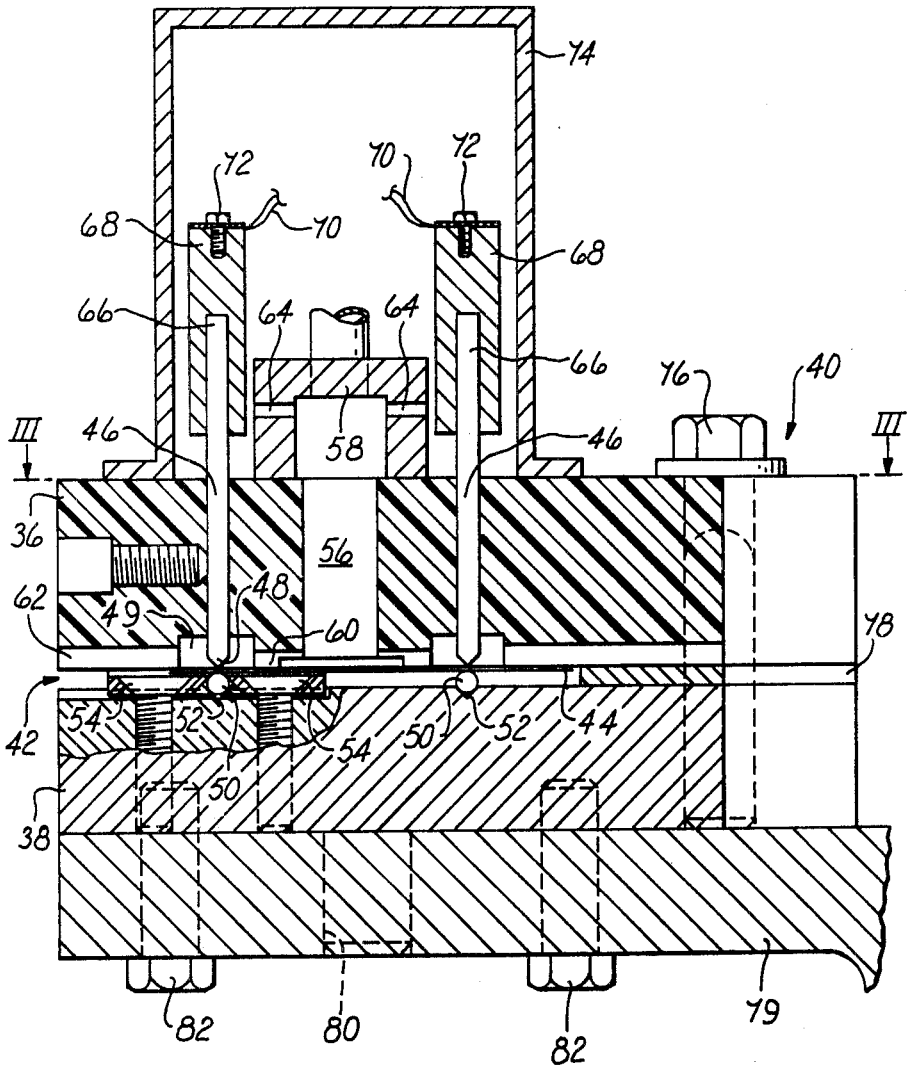
FIG. 4 is a vertical cross-section on the line IV—IV of FIG. 3.

A more practical example of a perforating head of this kind is shown in FIGS. 3 and 4. The head 34 comprises two halves 36 and 38 (FIG. 4) which are fixed together along one edge 40 so as to define a longitudinally extending slot 42 between them. The double width tipping paper web 44 is threaded into this slot, in use, and passes beneath two rows of pin electrodes 46 which are mounted in the upper half 36 of the head with their tips 48 extending through a recess 49 towards the slot 42.

The upper half 36 of the head is made of an insulating material such as TUFNOL (R.T.M.) while the lower half 38 is of metal so as to be an electrical conductor.

On the other side of the slot 42 a rod electrode 50 directly below each row of pin electrodes is held in a channel 52 in the other half 38 of the head 34 by means of clamping plates 54.

In order to cool the tips 48 of the pins, to remove products of combustion and to reduce paper burning, pressurised air is fed to a control slot 56 which extends right through the block half 36 from a manifold 58 on the top of the block. The air passes out of the sides of the slot 56, via channels 60 leading to the respective pin tips 48. Each channel 60 extends between the central recess 56 and the outer recess 49, and has an associated aligned outlet channel 62 through which the air leaves the perforation head.

The upper ends of the pins 46 are also cooled by providing an air hole 64 in the side of the manifold 58, opposite the upper end 66 of each pin.

In order to provide a greater surface area to dissipate heat, heads 68 are secured to the top 66 of each pin 46 and serve as heat sinks; the head 68 may be formed with fins to increase their heat emission. A high tension lead 70 is screwed to each head 68 by a screw 72.

A cover 74 is screwed over the pin head 68 and manifold 58 and has an outlet (not shown) for the discharge of air and heat.

The upper half 36 of the head is screwed to the lower half 38 by two bolts 76. A shim 78 spaces the two halves apart and determines the gap between the pin electrodes 66 and the rod electrodes 50. This gap, which may for example be set at 0.8 mm, can be altered by using a shim of different thickness.

In order to enable splices in the tipping paper to pass through the perforating head, the two halves may be sprung into engagement, for example by fixing the lower half 38 to a support 79 (as explained below) and mounting coil springs between the heads of the bolts 76 (which would of course need to be longer than those shown) and the upper surface of the half-head 36. A simple cam device (not shown) can then be used to urge the upper half slightly out of engagement with the lower half in response to a signal from a detector upstream of the perforator, indicating that a splice is approaching.

The perforating head 34 is mounted on a bracket 79 and may be capable of adjustment about the axis of a central vertical pin 80 to alter the angle of inclination of each row of pin electrodes to the direction of motion of the web 44. This adjustment can be made after slackening bolts 82 which pass through arcuate slots in the bracket and secure the head to the bracket 79.

When producing perforations for cigarette filter ventilation, a number of alternative methods may be employed to control the amount of perforation, and therefore ventilation. For example the perforating device may be arranged to produce more ventilation than is actually required, and when the paper is later gummed, ready for the assembly of the cigarettes and filter plugs, the gumming can be carried out in selected and variable areas so that some of the surplus perforations will be blocked (such selective gumming is referred to as "skip gap gumming").

Alternatively the perforations might be carried out after the gumming operation since sparking can easily pierce the layer of gum as well as the paper. In this case the amount of perforation will have to be controlled by the perforator device itself, but "skip gap" gumming will then be unnecessary. The sparks tend also to dry the gum around each hole, thus preventing the gum from spreading into and blocking the holes while the web is being applied to join filters to cigarettes.

In order to control the ventilation effect on finished cigarettes, a cigarette inspection device may be employed in the way described in our co-pending application No. 23271/77. This latter application describes a system in which, for example, every 48th cigarette produced is tested in regard to its ventilation, and the signals from such tests can therefore be used to regulate the amount of perforation applied to the tipping paper in the apparatus described in the present application.

It is also possible to use the apparatus described for pre-perforating other parts of the cigarette, such as the "plug-wrap" (outer part of the filterplug) or the cigarette paper itself. In these applications the perforations will be required to occur in spaced groups (i.e. one group per cigarette) so the electrical signal will be "gated" to occur at predetermined intervals.

Sparking apparatus according to this invention may also be used as follows: instead of cutting the continuous tipping paper web by means of a rotary knife, a row of closely spaced perforations may be formed across the web by sparking at each "cutting" position; this allows each successive portion of the tipping paper to be pulled off (breaking along the lines of perforations), for example in the manner described in our patent application No. 14939/76.

Figure 5:
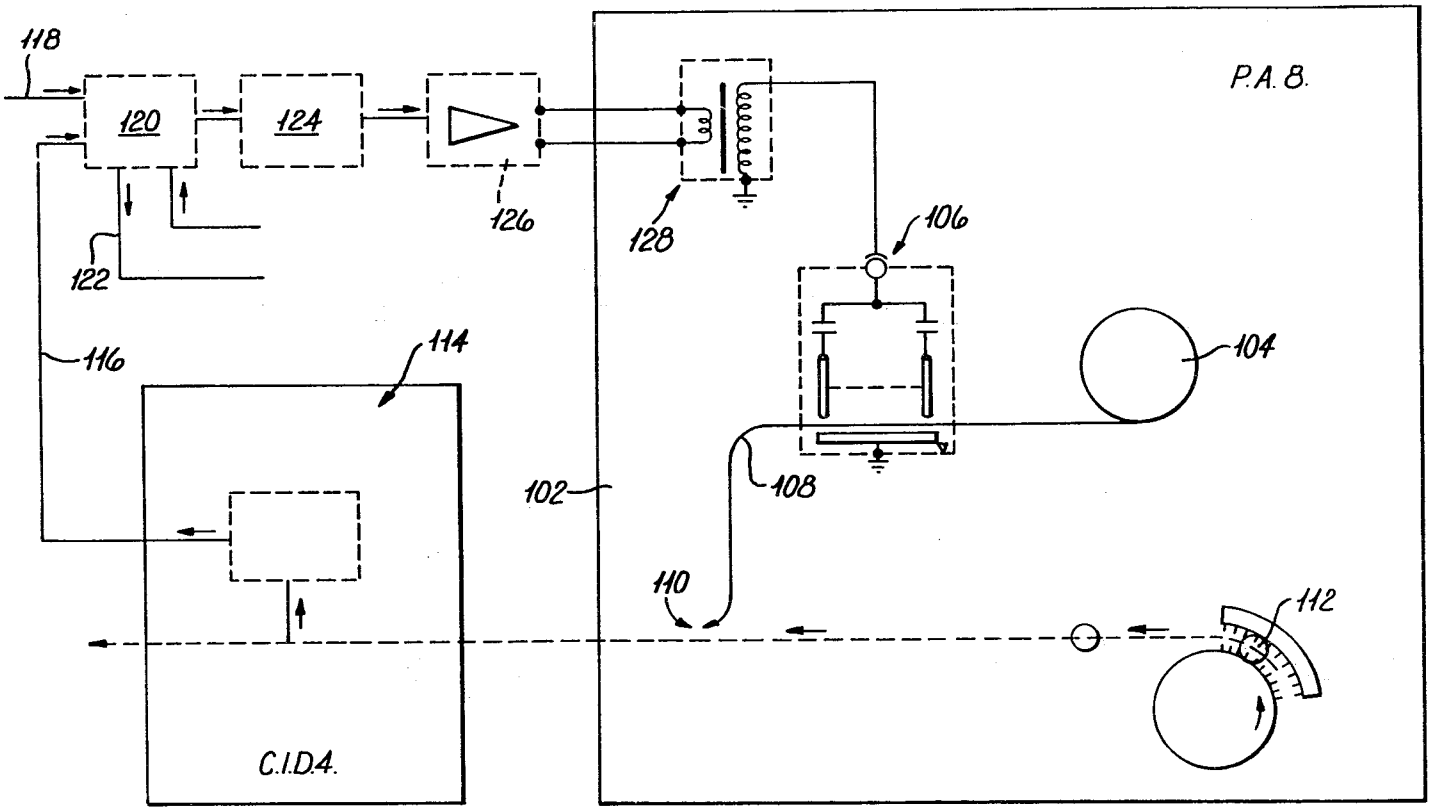
FIG. 5 is a schematic diagram of a tipping paper perforating and plug assembly system.
Figure 6:
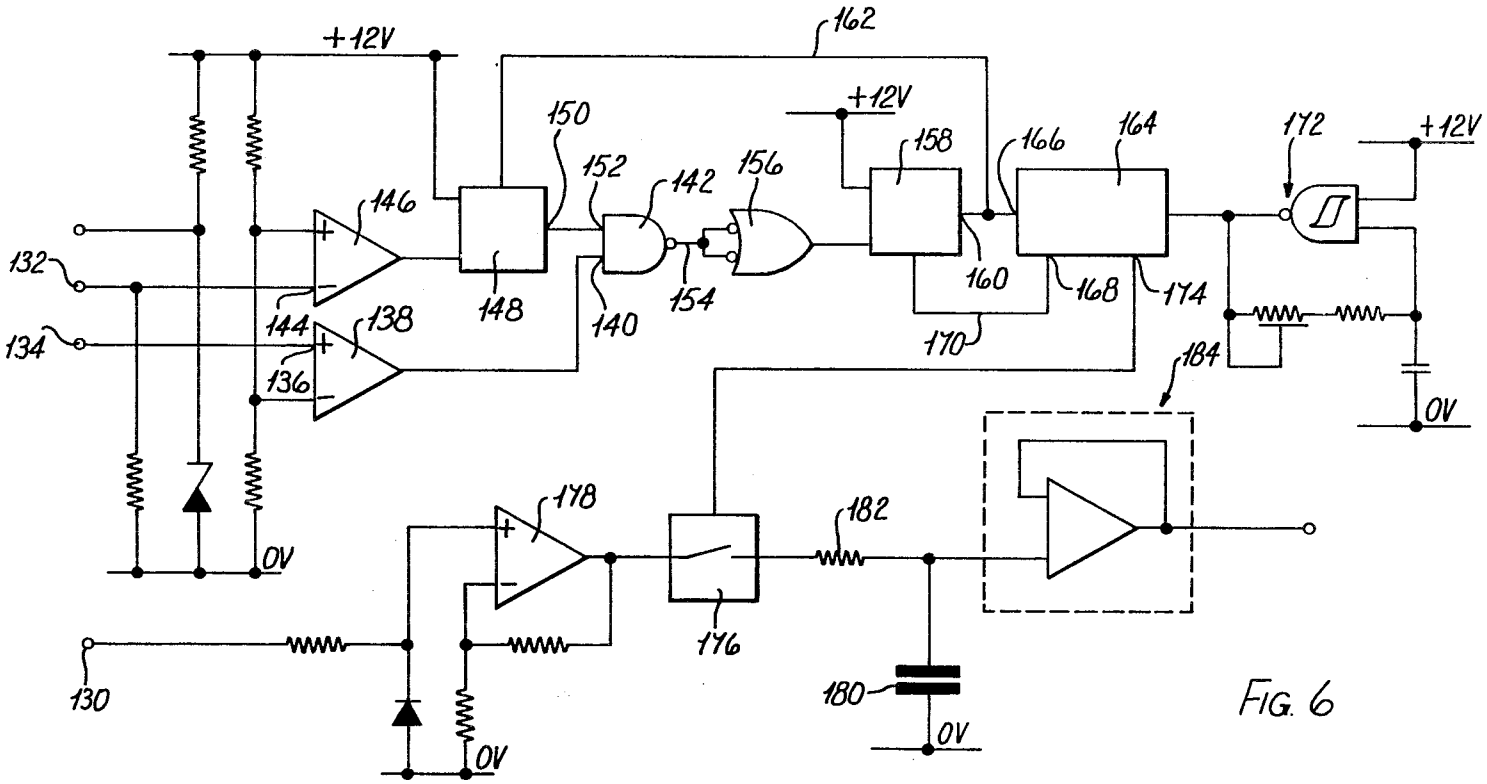
FIG. 6 is a circuit diagram of a perforation monitoring circuit.

An arrangement including an overall perfoation control system is shown in FIGS. 5 and 6.

In FIG. 5, a conventional plug assembler 102 such as the Molins PA8 includes a bobbin 104 of tipping paper which is used for attaching filter tips to cigarettes. A perforating device 106 of the kind described in detail above is mounted on the plug assembler and perforates the tipping paper 108 passing through it on its way to the assembly point 110.

At the same time plugs for subsequent assembly are being mechanically perforated at a station 112, using the arrangement described in our co-pending application No. 32970/77. The perforations of the plug wrap provided by this method are much coarser than the sparked perforations in the tipping paper.

The plugs and cigarette lengths are then joined at point 110 in a conventional manner using the perforated tipping paper 108. The assembled cigarettes pass to the inspection device 114, which is of the type described in our application No. 23271/77, and includes means for sampling the dilution of two out of every 48 cigarettes which are produced, that is, one cigarette from each row of the plug assembler.

The inspection device provides a signal on output line 116, which is derived from the average of the dilution measurement of a number of sampled cigarettes, and which is continuously compared with an adjustable reference signal 118 in a control circuit 120. This control circuit is also adapted to actuate an alarm via line 122 if the dilution level exceeds certain extreme high or low limits, indicating a serious malfunction. In addition the control circuit controls the frequency of a variable frequency oscillator 124 which drives a power amplifier 126, which in turn powers a high voltage output transformer 128. This provides the necessary a.c. voltage for the perforator 106, at the frequency required to achieve the desired level of perforation.

The inspection device 114 includes a circuit for sampling the dilution of a certain percentage of the cigarettes, which is shown in more detail in FIG. 6. This circuit includes a first input 130 for the characteristic signals for each cigarette produced by the inspection device, and a second input 132 for pulses produced by the inspection device and indicating the presence of a cigarette in the test position. A third input 134 receives a pulse which is produced by the inspection device twice every forty-eight cigarettes in the embodiment described here, each time a cigarette to be sampled arrives at the test position. This particular sampling rate arises when the inspection device is of the kind shown is British patent specification No. 1,217,203, as modified by the drawing of application No. 23271/77, in which the rotating drum carrying the cigarettes to be tested includes a device which is arranged to generate a pulse twice for each revolution, at the moment a cigarette occupying a specially modified testing flute reaches the test position. This pulse forms the input to terminal 134.

In use the pulse input to terminal 134 is fed to the non-inverting input 136 of a comparator amplifier 138. This causes a positive-going output to appear at its output which is connected to one input 140 of a NAND-gate 142. The pulse input to terminal 132, which occurs only twice every forty-eight cigarettes, in this example, is applied to the inverting input 144 of a comparator 146 and the resulting negative-going output pulse is applied to the clock input of a flip-flop 148.

This causes the flip-flop output 150 to change state, enabling NAND-gate 142 via input 152 so that the pulse appears at output 154 whenever input pulses are present at both inputs 140 and 152.

This negative-going output is inverted by NOR-gate 156 and applied to the clock input of a second flip-flop 158, to change state. The output 160 resets flip-flop 148 via line 162 and is also entered into a 128-bit shift register 164 via its input 166. About 625 $\mu$S after the entry of this "bit", an output appears at the first output 168 which is used to reset flip-flop 158 via line 170.

The shift register 164 is driven by a clock pulse generator 172, operating at about 25.6 KHz, so that the "bit" entered at input 166 is clocked through the register until after 128 clock pulses, corresponding to about 5 ms, a pulse appears at output 174. This pulse closes an electronic switch 176 which is connected to the output of an amplifier 178, which receives the cigarette characteristic signal applied to input 130. Thus the amplified signal passes through switch 176 only when the switch is closed, i.e. only when the desired cigarette is in the testing position.

The signal is used to charge a capacitor 180 via resistor 182 so that after a number of cigarettes have been sampled, the voltage across the capacitor assumes a value which is representative of the average dilution of those cigarettes. The time constant is preferably such that the voltage represents the average value of about fifty sampled cigarettes. A. d.c. output is obtained by means of a voltage follower 184, for control of the spark perforation oscillator.

The integrated circuit elements of FIG. 6 may typically be as follows:

| Reference No. | Type |
|---|---|
| 38,46,78 | LM324 |
| 84 | LM310 |
| 48,58 | 4013 |
| 42,56,72 | 4093 |
| 64 | 14562 |
| 76 | 4016 |

We claim:

1. Apparatus for perforating a moving web of tipping paper in a filter cigarette making system including means for making filter cigarettes using said tipping paper, comprising a series of separate electrodes on one side of the path of the web; cooperating electrode means on the other side of the web; a variable frequency high voltage A.C. power supply; a respective capacitor connecting each of the said series of electrodes to the output of the high voltage power supply, whereby the paper is perforated by electric sparks jumping between the separate electrodes and said cooperating electrode means; detection means for detecting the resistance to air flow through the perforations of at least some of the completed filter cigarettes; and control means responsive to said detection means for regulating the frequency of the high voltage power supply so as to vary the effective impedance of the capacitors and thus the current through the separate electrodes in order to achieve the desired air dilution in the filter cigarettes.

2. Apparatus according to claim 1 further comprising means for blowing gas across the separate electrodes.

3. Apparatus according to claim 1 in which said detection means includes testing means for testing successive cigarettes in a test position and for producing a signal characteristic of the resistance to air flow therethrough and means for averaging the characteristic signals of a number of successive cigarettes.

4. Apparatus according to claim 3 in which the control means includes a monitoring circuit having a first input for the cigarette characteristic signal, a second input for a signal indicative of the presence of a cigarette in the test position, a third input for a signal indicating that the cigarette is one to be sampled, and means for forming an average of those signals at the first input, which coincide with signals at the third input.

5. Apparatus according to claim 4 in which the monitoring circuit includes means for comparing the second and third inputs and for starting a timing device when the signals are present simultaneously at the second and third inputs; the timing device being arranged to connect the first input to an averaging device after a predetermined period; whereby the characteristic signal of a cigarette to be sampled is averaged with those of previous sampled cigarettes when it is correctly positioned in the test position.

6. Apparatus according to claim 4 in which the third input is connected to the non-inverting input of a first comparator amplifier whose output is connected to one input of a logic gate device, and the second input is connected to the inverting input of a second comparator amplifier whose output is connected to the clock input of a first flip-flop, the output of the flip-flop being connected to the second input of the logic gate; whereby the simultaneous presence of an input pulse on each of the second and third inputs causes the logic gate to produce an output pulse; the output of the second flip-flop being connected to the first flip-flop so as to reset it and also being connected to a clocked shift register arranged to produce a reset signal for the second flip-flop after a first predetermined period from the accurence of the output of the second flip-flop and to produce a signal for closing an electronic switch after a second predetermined period, which electronic switch is connected between the output of an amplifier connected to the first input, and a capacitor forming an averaging device for the characteristic signals; whereby, in use, the voltage across the capacitor assumes a value representing the average dilution of a predetermined number of sampled cigarettes.

* * * * *